United States Patent [19]

Ellison et al.

[11] Patent Number: 4,495,743

[45] Date of Patent: Jan. 29, 1985

[54] STANDING SEAM ROOF SYSTEM

[75] Inventors: Burlan E. Ellison, Duluth; Harry P. Spranca, Dunwoody; Christopher C. Hooper, Decatur, all of Ga.

[73] Assignee: Atlantic Building Systems, Inc., Atlanta, Ga.

[21] Appl. No.: 447,213

[22] Filed: Dec. 6, 1982

Related U.S. Application Data

[62] Division of Ser. No. 56,943, Jul. 12, 1979, Pat. No. 4,361,998.

[51] Int. Cl.[3] ..... E04B 5/52

[52] U.S. Cl. ..... 52/478; 52/520; 52/545

[58] Field of Search ..... 52/544, 520, 588, 529, 52/545, 478

[56] References Cited

U.S. PATENT DOCUMENTS

| | | | |
|---|---|---|---|
| 2,098,717 | 11/1937 | Calkins | 52/588 |
| 2,565,610 | 8/1951 | Kinghorn | 52/522 |
| 3,304,680 | 2/1967 | Birdwell | 52/588 |
| 3,982,373 | 9/1976 | Wilson | 52/588 |
| 4,091,588 | 5/1978 | Heirich | 52/588 |
| 4,223,503 | 9/1980 | Hague | 52/529 |
| 4,269,012 | 5/1981 | MacHingly | 52/520 |

FOREIGN PATENT DOCUMENTS

| | | | |
|---|---|---|---|
| 54537 | 10/1974 | Australia | 52/588 |

*Primary Examiner*—John E. Murtagh
*Assistant Examiner*—Kathryn Ford
*Attorney, Agent, or Firm*—Cushman, Darby & Cushman

[57] ABSTRACT

A fastening assembly fastens adjacent sheet metal panels together along adjacent longitudinal edges. One of the panels has a first raised edge comprising a male locking member including an upstanding portion, a downturned end, and a continuous bulge extending outwardly from the downturned end. The other of the panels has a second raised edge comprising a female locking member including an upstanding portion parallel to the male locking member upstanding portion; a downturned portion parallel to the male locking member downturned portion; and an inwardly turned flat portion abutting a bottom portion of the bulge of the male locking member and providing locking interfering therewith. Sealing means are disposed between the male and female members, and the female locking member also includes a backturned end portion including a curved portion at the backturn thereof.

8 Claims, 17 Drawing Figures

103
5
104
4
101
10
62
5
102
12
60
12
4
29
20
28
26
24
23
25
15

14

13
12

STANDING SEAM ROOF SYSTEM

CROSS-REFERENCE TO A RELATED APPLICATION

This application is a divisional of our application Ser. No. 56,943 filed July 12, 1979, now U.S. Pat. No. 4,361,998.

BACKGROUND AND SUMMARY OF THE INVENTION

The invention relates to a standing seam roof system and in particular includes particular clips for attaching the roof panels to the underlying supporting members (purlins), and provides particular edge configurations for the panels for attaching them together along cooperating longitudinal edges thereof.

By utilizing the roof system according to the invention, it is possible to provide roof panels that snap together without the use of expensive seaming machines, or the time-consuming operations associated therewith, yet it is possible to provide for mounting of the roof panels to the underlying supports so that free expansion and contraction of the roof panels is provided. The particular clip means utilized to attach the panels to the underlying supports provide vertical support to the roof panels and hold the panels above the supporting members in order to minimize compression of insulation between the panels and supporting members and thereby effecting maximum utilization of the insulation. Additionally, the edging or locking configurations, etc. are ideally suited for utilizing factory applied weather striping and sealant to effect more accurate placement of the sealant and quicker installation of the panels. Despite such operational advantages, the components of the roof system are easy to fabricate and install, and provide for a great deal of flexibility in the use of particular components thereof.

According to one aspect of the present invention clip means are provided for supporting adjacent roofing panels at longitudinal interconnected edges thereof, the clip means having the aboveindicated advantaged provided according to the invention. The clip means include a base member with an attachment portion disposed in a plane parallel to the plane of a purlin for attachment thereto, a central upstanding portion extending perpendicularly to the attachment portion and having a longitudinally elongated opening formed therein, and panel supporting portions extending in a plane perpendicular to the central upstanding portion at the top thereof, on both sides thereof. A tab member is operatively slideable in the longitudinally elongated opening for relative movement with respect to the base member and extends upwardly therefrom to interengage the panels attached together at the clip means. The configuration of the tab member can be varied depending upon the particular edge configuration of the panels, the base member being utilizable with a wide variety of such tab members. The tab member has one portion parallel to the base member disposed on one face thereof, a perpendicular portion extending through the longitudinal opening, and a main body portion extending upwardly from the base member on the opposite face as the first mentioned portion thereof.

For some uses, the clips means base member may include a pair of bottom portions parallel to the purlin with which they are associated, a pair of metal portions slanting upwardly from the bottom portions, and a top portion parallel to the purlin and interconnecting the middle portions, the longitudinally elongated opening cooperating with the tab member formed in the top portion. While providing a more complicated construction than the above-mentioned clip means, the clip means of this embodiment are also capable of positively vertically supporting the panels at the interconnecting edges thereof.

The clip means are utilized with a plurality of panels to provide a standing seam roof construction, each of the panels having parallel first and second raised edges extending generally longitudinally thereof with the tab member of the clip means dimensioned to fit between the raised edges, and the raised edges interconnected by particular fastening means. Such fastening means may include a snap cap arrangement, such as shown in copending commonly assigned application Ser. No. 057,006, filed 7/12/79 by Hooper, Ellison, and Spranca entitled "Capping Arrangements", or may comprise a wide variety of conventional edge interlocking arrangements. Preferred edge interlocking arrangements according to the present invention, however, include male and female particularly shaped interlocking components. For instance the male component may be formed with a corrugated edge, and the female component may include an upturned corrugated edge for cooperating with the male member corrugated edge, or may include a flat portion for engaging the edge. Alternatively, the male member may be formed with an outwardly extending bulge with the female member having a flat portion disposed underneath the bulge. At the spaced portions at which the clip means are provided, the tab member may include a turned-back portion overlapping the male interlocking component. Still further, the male locking component can have a flat edge, and fasteners can be provided connecting the male and female components together at overlapping portions thereof. Sealing is preferably provided between the male and female components in all the configurations.

In situations where the roof panels are not long enough to effectively cover a roof area, the edges of panels can be overlapped with the standing seams of the overlapped panels being coextensive. The ends of the edge configurations of the underlying panels are formed flat in such an arrangement, the flat portions being disposed between the male and female locking members of the overlying panels.

It is the primary object of the present invention to provide a versatile, efficient standing seam roof construction and particular advantageous components thereof. This and other objects of the invention will become clear from an inspection of detailed description of the invention and from the appended claims.

DETAILED DESCRIPTION OF THE DRAWINGS

Figure 1:
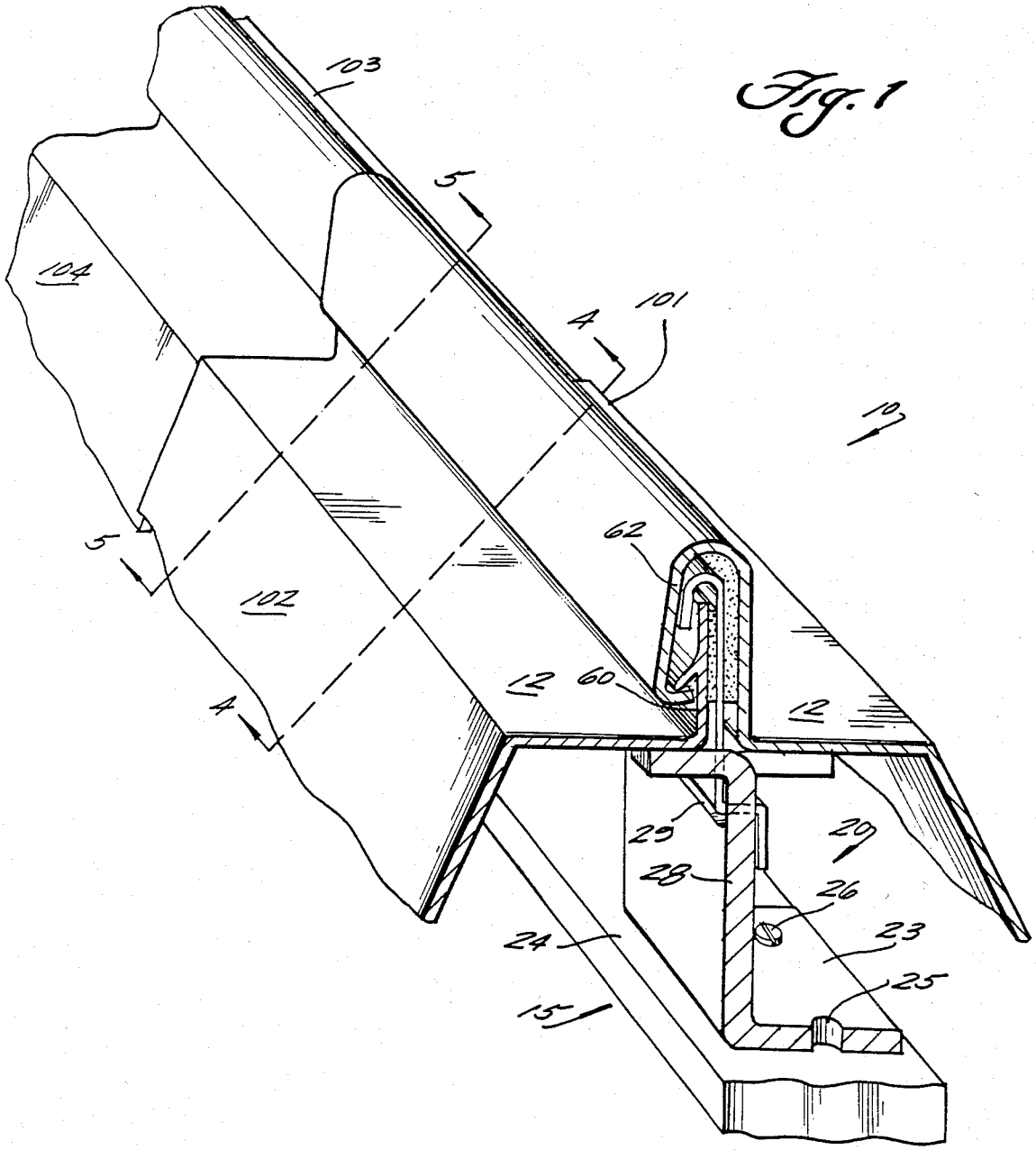
FIG. 1 is a perspective view of an area of panel edge interengagement and an exemplary roofing system according to the invention.
Figure 2:
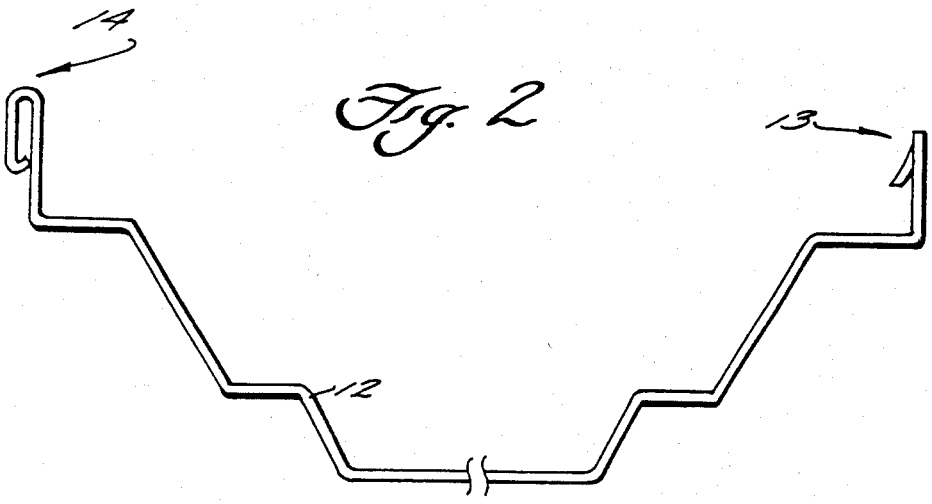
FIG. 2 is a side view of an exemplary roofing panel that may be utilized and practicing the invention.
Figure 3:
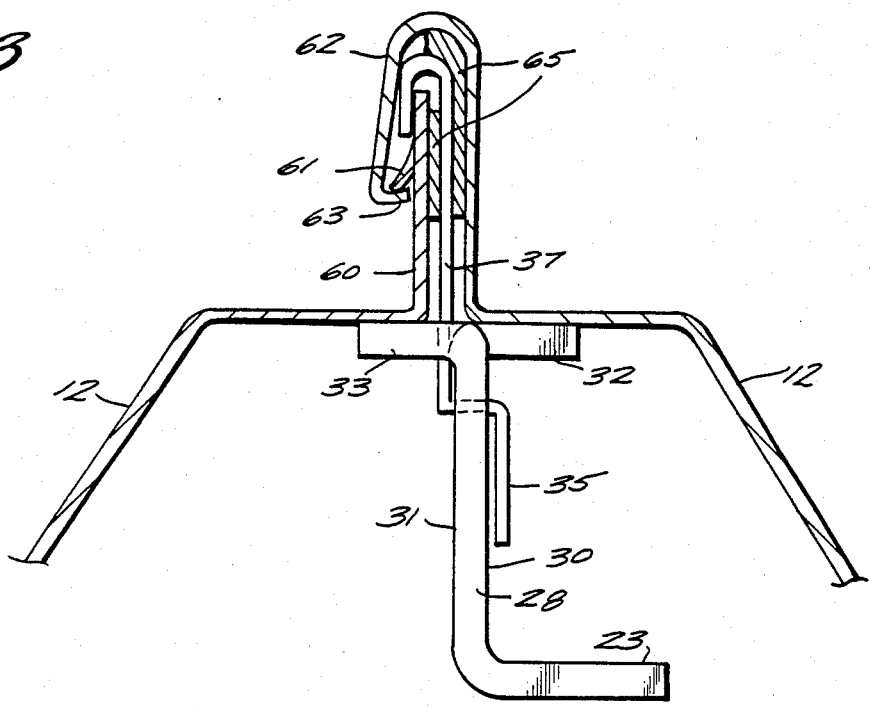
FIGS. 3, 4, and 5 are side views of: the interengagement between panel edge components at a clip means, and taken along lines 4—4 and 5—5 of FIG. 1, respectively.
Figure 4:
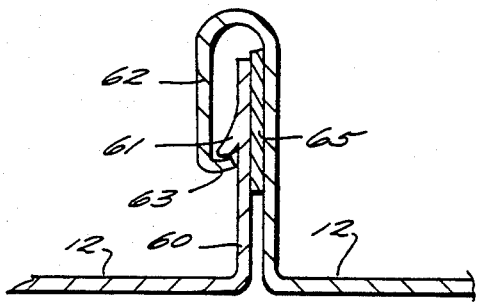
Figure 5:
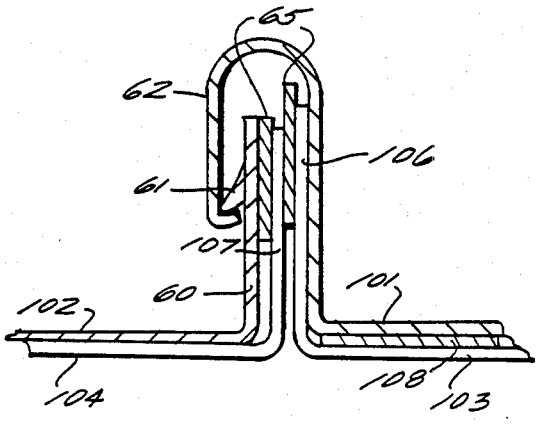

An exemplary standing seam roof construction according to the present invention is illustrated generally at 10 in FIG. 1. The system includes a plurality of panels 12 each having first and second raised edges 13 and 14 respectively (see FIG. 2) with the edges being substantially parallel to each other and adapted to be fastened together with opposite edges of adjacent panels. For instance, as illustrated in FIG. 1 the first edge configuration 13 of one panel 12 is fastened together with a second edge configuration 14 of another panel 12. A plurality of clip means, shown generally at 15 in the drawings are disposed at spaced points along the underlying supporting components to which the panels 12 are connected (purlins), each clip including a base attached directly to the purlin, and a tab extending upwardly from the base and slideable with respect thereto to allow expansion and contraction of the roof panels with respect to the interconnections to the purlins, the tab member being received between fastening components of the edges 13, 14.

A preferred clip means according to the present invention is illustrated most clearly in FIGS. 1, 3, 6, 7, and 17. This clip means 15 includes a base 20 and tab member 21. The base 20 includes an attachment portion 23 disposed in a plane parallel to the plane of a purlin 24 or like underlying support member to which the base member 20 is to be attached. The base member 23 may be provided with openings 25 (see FIGS. 6 and 7) for receipt of fasteners such as screws 26 (see FIG. 1), or may otherwise be affixed to a purlin 24 as with adhesive, etc. A central upstanding portion 28 is provided which extends perpendicularly to the attachment portion 23 and has a longitudinally elongated opening 29 formed therein. Panel supporting portions extend in a plane perpendicular to the central upstanding portion 28 from the top thereof, on both sides thereof. The central upstanding portion 28 has a first face 30 and a second face 31. The panel supporting portions preferably comprise a first portion 32 extending perpendicularly out from the first face 30 and being generally coextensive with the elongated opening 29, and a pair of spaced second portions 33 extending perpendicularly out from the second face 31 and being disposed on either side of the opening 29 so as not to interfere with relative movement of the tab member 21 with respect to the base member 20 in the elongated opening 29. The panel supporting portions 32, 33 abut the bottoms of the panels 12 with which they are associated, providing vertical support therefor. Also, the portions 33 can provide stops for limiting movement of the tab member with respect to the opening 29, if desired.

Figure 7:
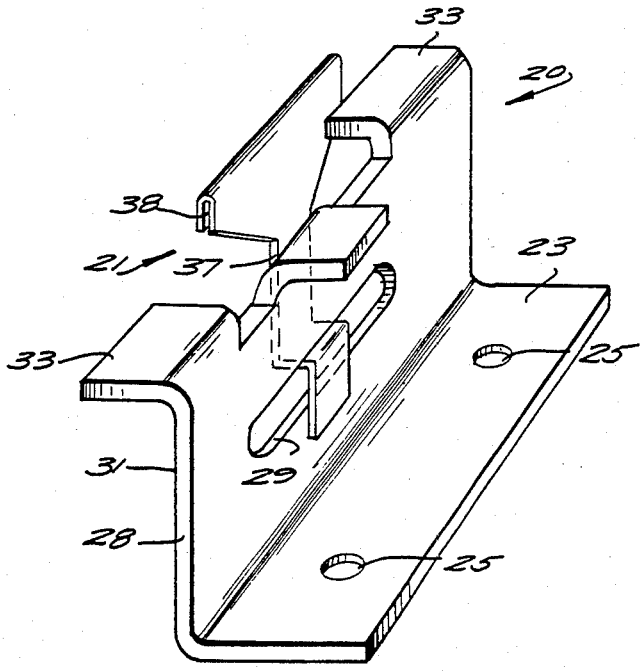

The tab member 21 is dimensioned so that it has a width at the opening 29 substantially less than the length of the opening 29. The tab member 21 includes an end portion 35 parallel to and disposed against the face 30 of the portion 28 of base 20, a middle portion 36 extending through the opening 29 and perpendicular to the end portion 35 and portion 28, and a main body portion 37 parallel to and disposed against the second face 31 of the portion 28 extending upwardly therepast to a position between the first and second panel edges 13, 14 of adjacent interconnected panels. A portion of the main body portion 37 extending upwardly past the central upstanding base member portion 28 may be flared outwardly, as seen in FIG. 7, so as to have a substantially greater width than the width of the tab member middle portion 36, the outwardly flared portion not interfering with the panel supporting second portions 33.

Figure 6:
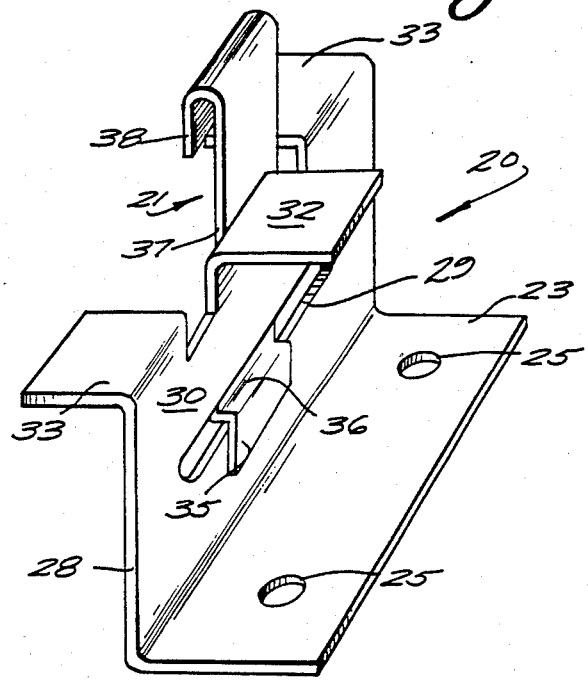
FIGS. 6 and 7 are perspective views of particular exemplary clip means according to the present invention.

The end of the main body portion 37 of the tab member 21 may have a wide variety of shapes to particularly adapt it for use in interconnecting adjacent panels 12, the particular configuration provided being dependent upon the fastening means employed. As illustrated in FIGS. 6 and 7, the main body portion 37 has a return bend 38 formed at the end thereof to overlap a male locking component of the edge configurations 13, 14, while in the FIG. 17 embodiment (which also includes a flared end) a pair of oppositely extending flanges 40 are provided.

Figure 13:
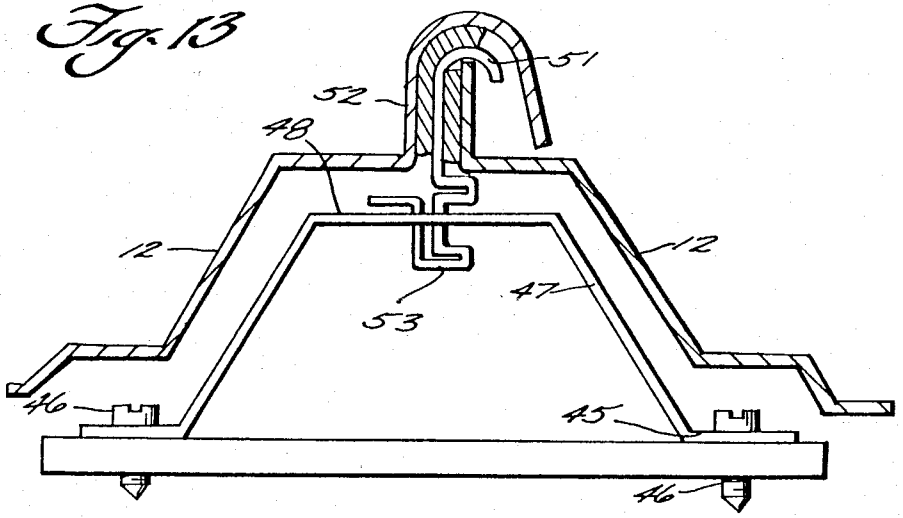
FIGS. 13 and 14 are side and perspective views respectively of another exemplary embodiment of panel edge interconnecting components and clip means according to the invention.
Figure 14:
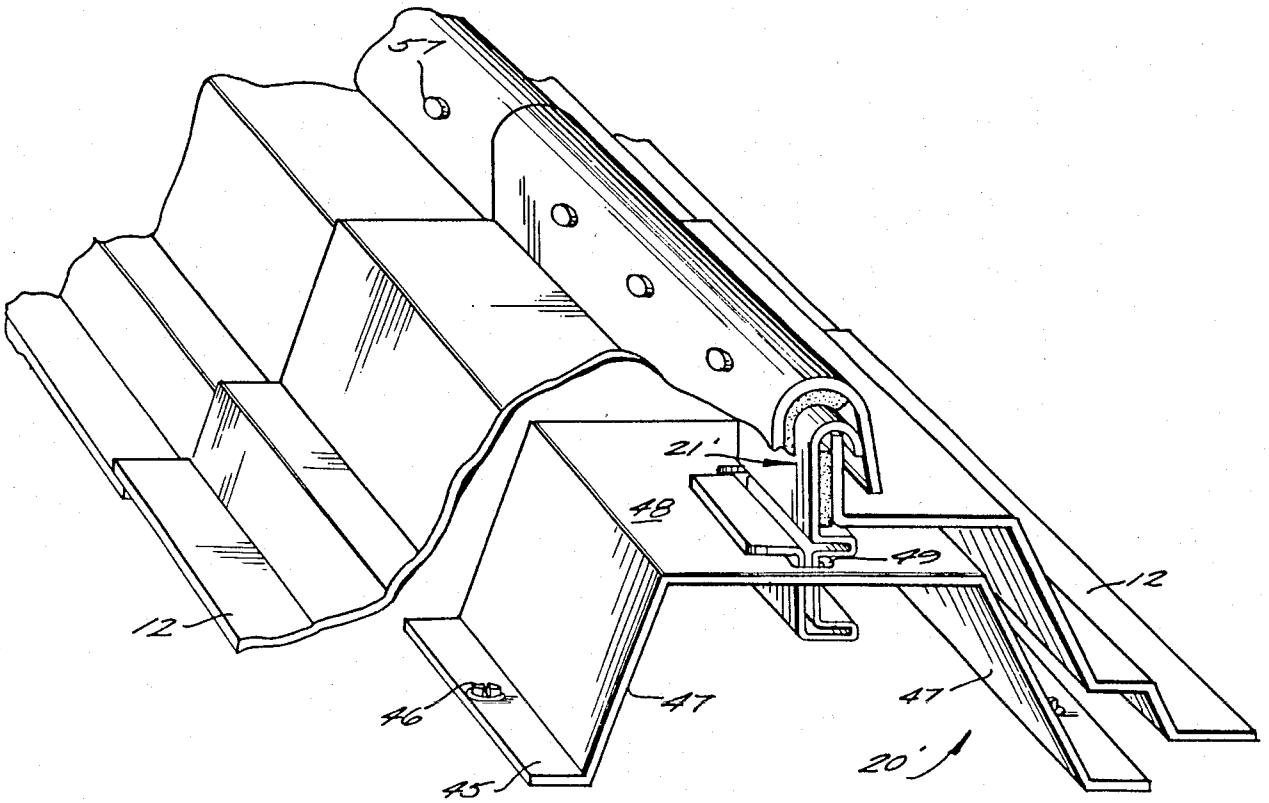

Another embodiment of clip means that may be utilized according to the present invention is illustrated in FIGS. 13 and 14. In this embodiment, for each clip means the base member 20' includes a pair of bottom portions 45 parallel to an underlying purlin 24 or other structural component to which they are to be connected, the connection being effected utilizing self-drilling screws 46 or the like. The base member 20' further includes a pair of middle portions 47 slanting upwardly from the bottom portions 45, and a top portion 48 parallel to the purlin and interconnecting the middle portions 47 and for engaging the adjacent panels 12 adjacent the first and second edges thereof for providing vertical support for the panels. The middle portion 48 includes a longitudinally elongated opening 49 in which the tab member 21' is slideable.

The tab member 21' includes a first end portion 51 (which may be turned-back) disposed between the raised edges of adjacent panels 12, an upstanding body portion 52 extending perpendicularly to the base member top portion 48, and a second end portion 53 extending perpendicularly to the body portion 52 from one face thereof and parallel to the base member top portion 28 and disposed therebelow (see FIG. 13). An intermediate flange 54 is also provided extending parallel to the second end portion 53 from both faces of the body portion 52 and disposed above the second end 53. The intermediate flange 54 is spaced from the second end 53 along the body portion 52 a distance slightly greater than the thickness of the base member top portion 48. The body portion 52 has a width, where it extends through the longitudinally elongated opening 49, less than the length of that opening.

The means for fastening the first and second raised panel edges of adjacent panels together along the lengths thereof may take a wide variety of forms. One general preferred form is the formation of the first edge 13 as a male locking member, and the second edge 14 as a female locking member. The turned-back end portion 38 (or 51) of the tab member 21 (21') can be looped over and engage the male locking member, disposed between the male and female locking members.

In the embodiment of FIGS. 13 and 14, the fastening means further comprises a plurality of elongated fasteners 57 which extend through overlapping portions of the male and female locking members and, where present, the tab member 21', to fasten them together. In the other embodiments of the fastening means including male and female members, particular surface manifestations of the male and female members provide for snap-together interlocking thereof.

In the embodiment of FIGS. 1 and 3-5, the male locking member is 60 and has locking portions thereof formed as buttons 61 extending outwardly from the surface of the member 60, being formed at spaced points along the length of the member 60. Similar buttons are illustrated in U.S. Pat. No. 3,982,373. In this embodiment the female locking member is illustrated at 62, and comprises an upturned hook-like end 63 providing a locking portion for engaging the buttons 61. The buttons 61 and hook-like end 63 are so shaped that the female locking members 62 may be readily pushed over the male locking member, the member 62 being cammed outwardly until the hook 63 passes the bottoms of buttons 61, at which time it returns to lock therewith. Mastic 65, or other sealing composition, is preferably provided between the components of the edge, and such material may be formed on the components at the factory.

Figure 8:
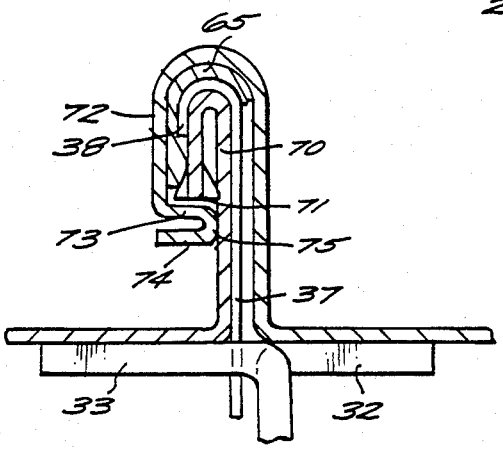
FIGS. 8–12 are side views showing the interengagement between panel longitudinal edges at a clip, utilizing exemplary panel edge interlocking components according to the invention.
Figure 9:
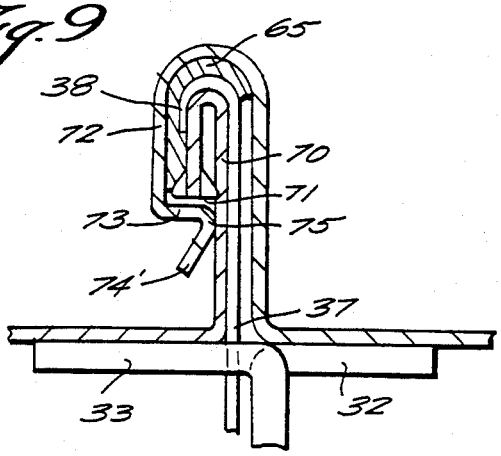
Figure 10:
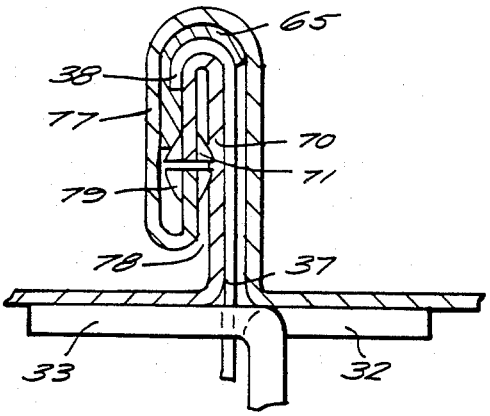
Figure 11:
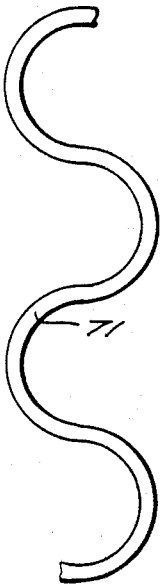

In the embodiments of FIGS. 8-10, the male locking member is shown at 70 and includes a downturned corrugated terminating edge 71 formed therein. An end view of this terminating edge 71 is provided in FIG. 11. The corrugations may be provided continuously along the edge, or intermittently therealong. In FIGS. 8-10, various modifications of the female locking member are illustrated. In FIG. 8, the female locking member 72 comprises an inwardly turned flat portion 73 providing a locking portion operatively engaging the corrugated edge 71, with the terminating end 74 of the members 72 turned backwardly and parallel to the flat portion 73. In the FIG. 9 embodiment, the basic locking mechanism is the same only the end portions 74' is turned-back to provide an angle with respect to the flat portions 73. In either of the embodiments of FIGS. 8 and 9, the rounded portion 75 between the end 74, 74' and the flat portion 73 provides a camming arrangement for facilitating movement of the component parts together.

In the FIG. 10 embodiment, the female locking member 77 includes an upturned hooked-like end 78 having a corrugated edge 79 that provides a locking portion interfering with the male locking member corrugated edge 71. The corrugations on the edge 79 are provided to interfere with the corrugations 71. A camming action is provided between the corrugations 79, 71 to facilitate movement of the members 70, 77 together to provide a locking interengagement therebetween.

Figure 12:
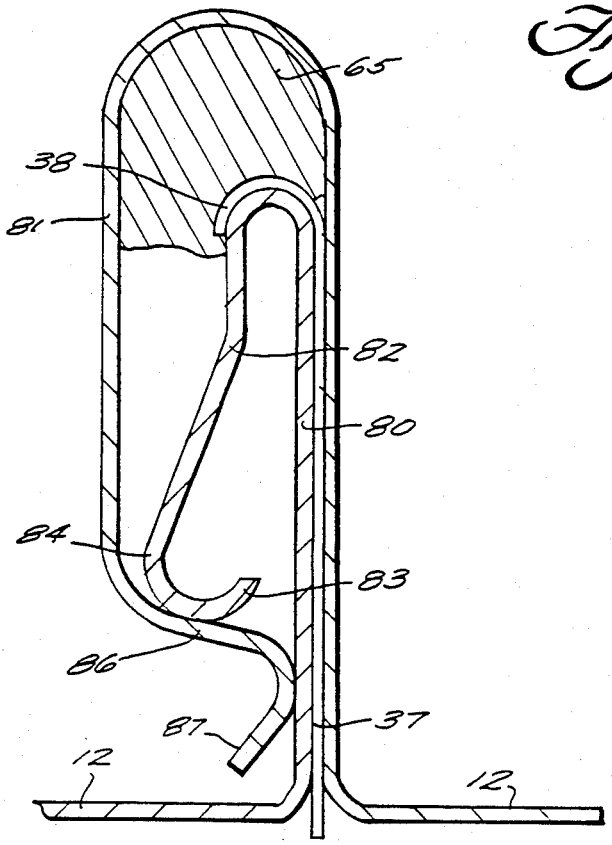

In the embodiment of FIG. 12, the male locking member is illustrated at 80, and the female locking member at 81. The male locking member includes a downturned portion 82 and has the terminating edge 83 thereof formed as an upturned hook-like portion, and includes a bulge 84 extending toward the female locking member 81. The female locking member 81 comprises an inwardly turned flat portion 86 providing a locking portion operatively engaging the male locking member beneath the bulge 84, and the end 87 of the female locking member 81 is downturned so that a rounded portion 88 is provided. A camming action between the portions 84, 86 facilitates movement of the members 80, 81 into interlocking engagement.

Figure 16:
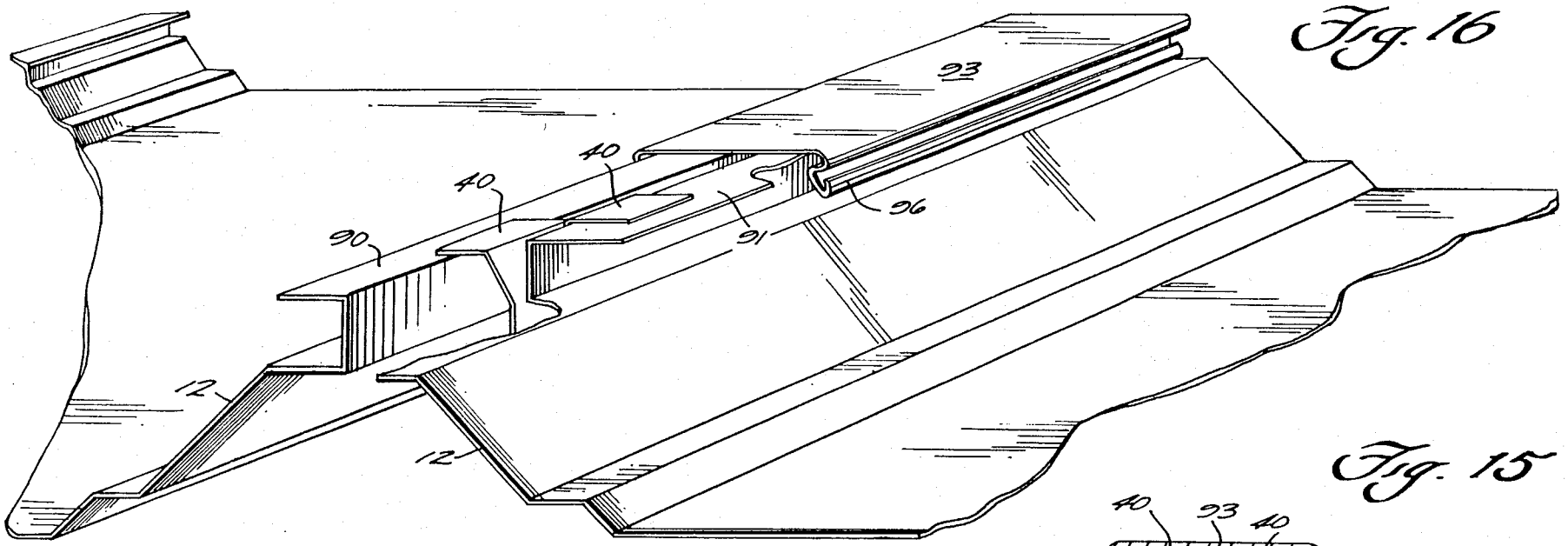
FIGS. 15 and 16 are side and perspective views respectively of another embodiment of panel interconnecting configurations according to the invention.
Figure 15:
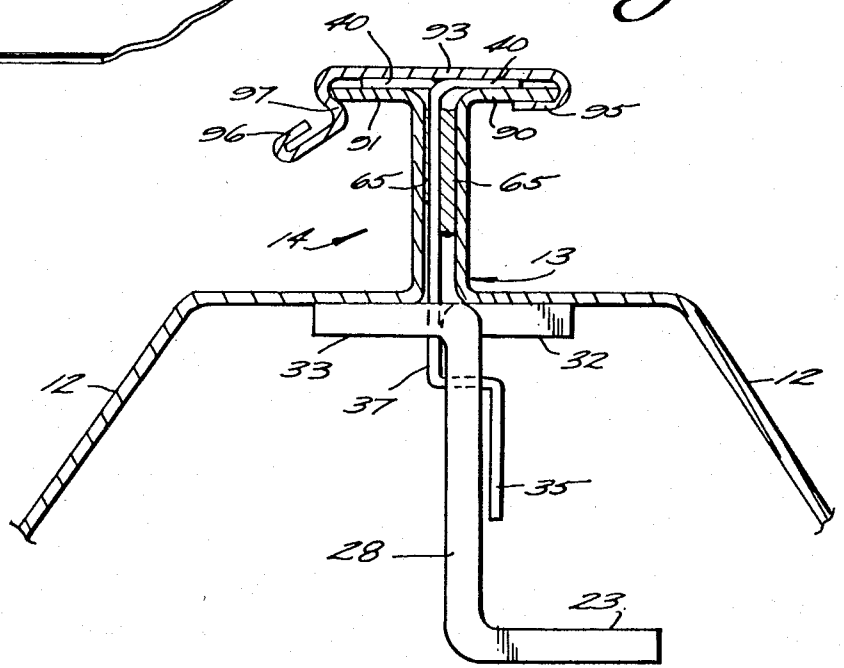
Figure 17:
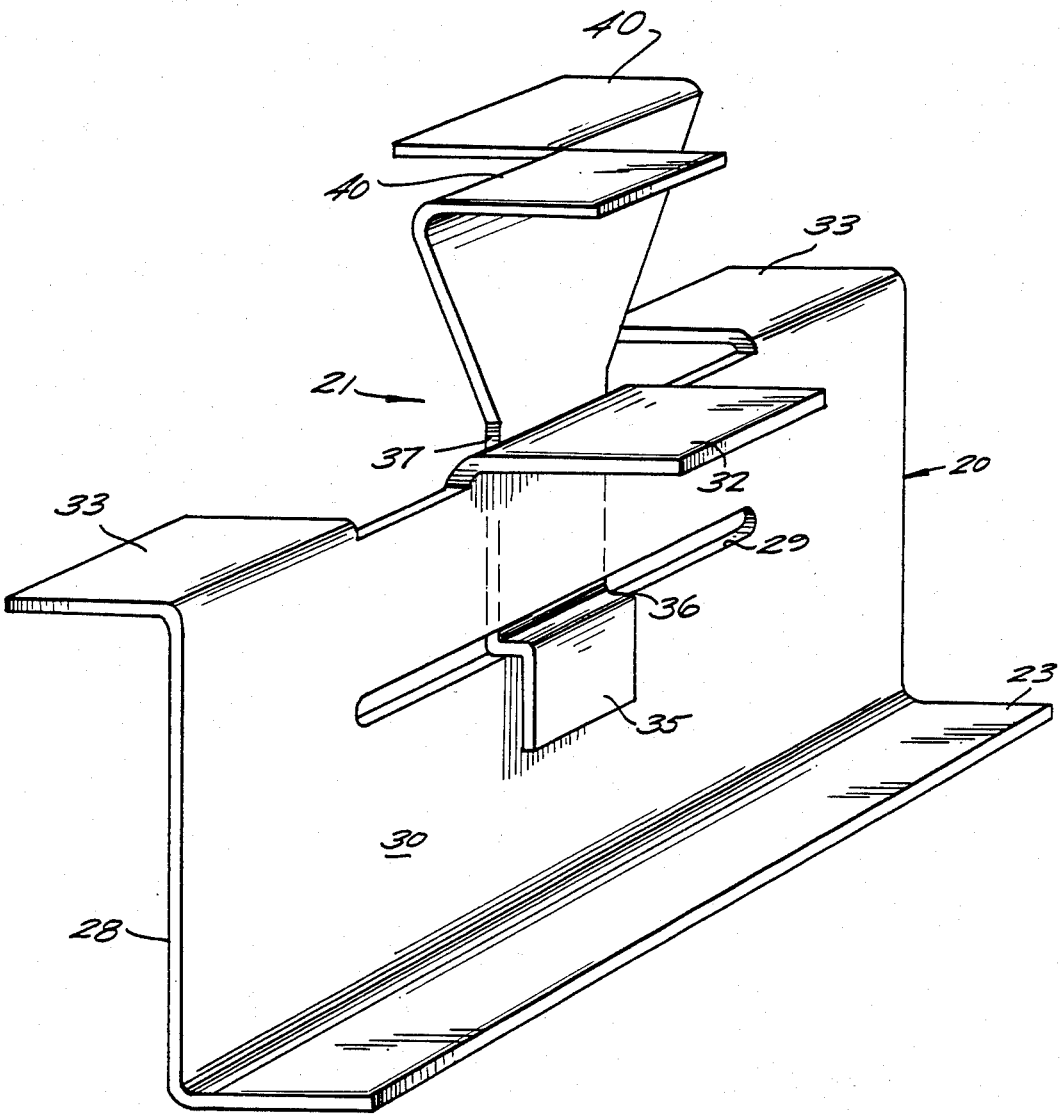
FIG. 17 is a perspective view of clip means utilizable with the panel interconnections of FIGS. 15 and 16.

In FIGS. 15-17, the fastening means do not comprise interlocking male and female components, but rather include cooperating flanges covered by a snap cap. The first and second raised panel edges 13, 14 of adjacent panels are formed with oppositely extending flanges 90, 91 respectively, which flanges extend parallel to and are overlapped by the tab member 21 flanges 40. A snap cap 93 snaps over all of the flanges and maintains them together, with the mastic or other sealing means 65 providing resilient means disposed between the tab member body 37 and the first and second edges 13, 14. The snap cap 93 comprises a first end 95 formed as a hook for extending over the first edge flange 90 and one of the tab member flanges 40 and allows the cap 93 to pivot thereabout. The second end includes a terminating portion 96 that may be engaged by a thumb and forefinger, and has an intermediate portion of that end bent to form a cam 97 for engaging the second edge flange 91 and camming it toward tab member 37, with the resilient means 65 being compressed, to allow passage of the cam 97 therepast. The snap cap and attaching arrangement is described more completely in copending commonly assigned application Ser. No. 057,006, filed 7/12/79 of Hooper, Ellison, and Spranca entitled "Cap Arrangement".

For all embodiments of the invention, at positions wherein clips are provided for attaching adjacent panel edges to the underlying supporting structures of the roof, the tabs (21, 21') associated with the clip means are disposed between the edge components. At positions where clip means 15 are not provided, the raised edge portions are connected together without tab means therebetween, as illustrated for one embodiment in FIG. 4. In situations where the individual panels 12 are not long enough to cover the entire roof which they form, the panels are overlapped with similar panels along the slope of the roof to effect complete coverage. In such situations, the panels up the slope of the roof overlap the panels further down the slope of the roof with the raised interconnecting edges of such panels being coextensive. A preferred manner in which such overlapping can be provided without interferring with the fastening together of the raised edges of adjacent panels is seen most clearly with reference to FIGS. 1 and 5. Panel 101 is a first panel, panel 102 a second panel, panel 103 a third panel, and panel 104 a fourth panel, the panels 101 and 102 normally being provided further up the slope of the roof than the panels 103, 104. The interlocking edge configurations of each are the same, in this case being the male and female locking components illustrated most clearly in FIG. 3 and including a male locking member 60 and female locking member 62. For the first and second panels, the locking members are formed along the length of raised edges thereof. For the third panel, a female locking member 62 is formed over the majority of the length thereof, however the end thereof adjacent the third panel 101 comprises a flat upstanding portion 106 (see FIG. 5). The fourth panel 104 raised edge comprises a male locking member 60 over the majority of the length thereof, but the end thereof adjacent the second panel 102 comprises a flat upstanding portion 107 (see FIG. 5). The flat upstanding portions 106, 107 are received between the male and female locking members 60, 62 of the first and second panels 101, 102, and thus the panels 101, 103 and 102, 104 are overlapped a distance corresponding to the length of the flat upstanding portions 106, 107. After the area of overlap, the locking members 60, 62 of the third and fourth panels 103, 104 are provided, providing an extension of the locking members associated with the first and second panels 101, 102. If desired, resilient sealing material, such as illustrated at 108 in FIG. 5, may be provided between the overlapping panels (e.g. 101, 103) at the area of overlap thereof.

It will thus be seen that according to the present invention a roof system, and particular clip means and edge interlocking configurations associated therewith, have been provided which allow for free expansion and contraction of the roof panels, which easily snap together and thus obviate the use of expensive seaming machines and their corresponding time-consuming operations, provide proper vertical support for the roof panel and hold the panel above the supporting members (purlins) to provide efficient use of insulation, can be readily fabricated and quickly installed, provide good versatility and interchangeability of parts, and allow for ready overlapping of panels over the length of a roof. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. A standing seam fastening assembly for fastening adjacent sheet metal panels together along adjacent longitudinal edges thereof, the panels extending generally in a first plane; said assembly comprising one of the panels having a first raised edge comprising a male locking member including an upstanding portion extending generally perpendicular to said first plane, a downturned end parallel to but spaced from said upstanding portion, and a bulge extending outwardly from the downturned end away from said upstanding portion continuously along substantially the entire length of the panel, said bulge having a rounded bottom surface adjacent a terminating edge thereof; and the other of the panels having a second raised edge, at an end thereof, comprising a female locking member including an upstanding portion extending generally perpendicular to said first plane and parallel to the male locking member upstanding portion; a downturned portion parallel to the male locking member downturned portion and connected thereto by a rounded bend; and an inwardly turned elongated flat portion immediately adjacent said end thereof and having an extent greater than the width of said panel, and abutting said rounded bottom surface of said continuous bulge of said male locking member and providing locking interfering engagement therewith.

2. An assembly as recited in claim 1 wherein said female locking member also includes a backturned terminating end portion extending away from said locking member and including a curved portion at the backturn thereof, and terminating immediately after said curved portion.

3. An assembly as recited in claim 2 further comprising sealing means disposed between said male and female members.

4. An assembly as recited in claim 1 further comprising sealing means disposed between said male and female members.

5. An assembly as recited in claim 1 adapted for installation and the framing of a building including purlins, and further comprising:

a plurality of clip means disposed at spaced points along the purlins and operatively rigidly attached thereto and for supporting said adjacent first and second raised edges of said panel; each clip means including a tab member dimensioned to fit between said first and second raised edges, a base member rigidly attached to a purlin, and means for mounting said tab member to said base member so that relative movement therebetween is allowed parallel to said panel edges, said tab member including a return bend portion at a free end thereof, overlapping a portion of said male locking member between said upstanding portion and said downturned end thereof.

6. An assembly as recited in claim 2 adapted for installation and the framing of a building including purlins, and further comprising:

a plurality of clip means disposed at spaced points along the purlins and operatively rigidly attached thereto and for supporting said adjacent first and second raised edges of said panel; each clip means including a tab member dimensioned to fit between said first and second raised edges, a base member rigidly attached to a purlin, and means for mounting said tab member to said base member so that relative movement therebetween is allowed parallel to said panel edges, said tab member including a return bend portion at a free end thereof, overlapping a portion of said male locking member between said upstanding portion and said downturned end thereof.

7. An assembly as recited in claim 3 adapted for installation and the framing of a building including purlins, and further comprising:

a plurality of clip means disposed at spaced points along the purlins and operatively rigidly attached thereto and for supporting said adjacent first and second raised edges of said panel; each clip means including a tab member dimensioned to fit between said first and second raised edges, a base member rigidly attached to a purlin, and means for mounting said tab member to said base member so that relative movement therebetween is allowed parallel to said panel edges, said tab member including a return bend portion at a free end thereof, overlapping a portion of said male locking member between said upstanding portion and said downturned end thereof.

8. An assembly as recited in claim 4 adapted for installation and the framing of a building including purlins, and further comprising:

a plurality of clip means disposed at spaced points along the purlins and operatively rigidly attached thereto and for supporting said adjacent first and second raised edges of said panel; each clip means including a tab member dimensioned to fit between said first and second raised edges, a base member rigidly attached to a purlin, and means for mounting said tab member to said base member so that relative movement therebetween is allowed parallel to said panel edges, said tab member including a return bend portion at a free end thereof, overlapping a portion of said male locking member between said upstanding portion and said downturned end thereof.

* * * * *